US011230931B1

(12) United States Patent
Dvorozniak et al.

(10) Patent No.: US 11,230,931 B1
(45) Date of Patent: Jan. 25, 2022

(54) INSERTS FOR AIRFOILS OF GAS TURBINE ENGINES

(71) Applicant: Raytheon Technologies Corporation, Farmington, CT (US)

(72) Inventors: Lucas Dvorozniak, Bloomfield, CT (US); Dominic J. Mongillo, Jr., West Hartford, CT (US)

(73) Assignee: RAYTHEON TECHNOLOGIES CORPORATION, Farmington, CT (US)

( * ) Notice: Subject to any disclaimer, the term of this patent is extended or adjusted under 35 U.S.C. 154(b) by 0 days.

(21) Appl. No.: 16/920,496

(22) Filed: Jul. 3, 2020

(51) Int. Cl.
*F01D 5/18* (2006.01)

(52) U.S. Cl.
CPC ..... *F01D 5/189* (2013.01); *F05D 2220/32* (2013.01); *F05D 2250/11* (2013.01); *F05D 2250/121* (2013.01); *F05D 2250/14* (2013.01); *F05D 2260/201* (2013.01); *F05D 2260/2212* (2013.01); *F05D 2300/10* (2013.01)

(58) Field of Classification Search
CPC ..... F01D 5/186; F01D 5/187; F01D 5/188; F01D 5/189; F01D 9/065; F01D 25/12; F01D 5/16; F05D 2220/32; F05D 2250/11; F05D 2250/70; F05D 2250/121; F05D 2250/14; F05D 2240/127; F05D 2240/122; F05D 2240/126; F05D 2260/201; F05D 2260/202; F05D 2260/20; F05D 2260/221; F05D 2260/2212; F05D 2260/2214; F05D 2260/22141; F05D 2300/10; F23R 2900/03044; F23R 3/002
See application file for complete search history.

(56) References Cited

U.S. PATENT DOCUMENTS

| | | | | |
|---|---|---|---|---|
| 3,767,322 | A | 10/1973 | Durgin et al. | |
| 4,437,810 | A | 3/1984 | Pearce | |
| 5,361,828 | A * | 11/1994 | Lee | F01D 5/187 165/109.1 |
| 5,511,937 | A | 4/1996 | Papageorgiou | |
| 6,554,563 | B2 * | 4/2003 | Noe | F01D 5/189 415/115 |
| 10,006,295 | B2 * | 6/2018 | Spangler | F01D 5/02 |

(Continued)

FOREIGN PATENT DOCUMENTS

| | | |
|---|---|---|
| EP | 1284338 A2 | 2/2003 |
| EP | 1452693 A2 | 9/2004 |

(Continued)

OTHER PUBLICATIONS

European Search Report for European Application No. 21183551.7, dated Dec. 1, 2021, 8 pages.

*Primary Examiner* — J. Todd Newton
*Assistant Examiner* — Eric J Zamora Alvarez
(74) *Attorney, Agent, or Firm* — Cantor Colburn LLP

(57) ABSTRACT

Baffle inserts for airfoils of gas turbine engines are described. The baffle inserts include a baffle insert body having a first side portion and a second side portion, wherein each side portion has a respective end, a first set of vortex generation elements is arranged at the end of the first side portion, and a second set of vortex generation elements is arranged at the end of the second side portion. The first set of vortex generation elements and the second set of vortex generation elements are arranged at an aft end of the baffle insert body.

20 Claims, 11 Drawing Sheets

(56) References Cited

U.S. PATENT DOCUMENTS

| | | | | |
|---|---|---|---|---|
| 2016/0333735 | A1* | 11/2016 | Bunker | F01D 9/023 |
| 2017/0268358 | A1* | 9/2017 | Lee | F01D 5/186 |

FOREIGN PATENT DOCUMENTS

| | | | |
|---|---|---|---|
| EP | 3124747 | A1 | 2/2017 |
| EP | 3502420 | A1 | 6/2019 |
| EP | 3663524 | A1 | 6/2020 |

* cited by examiner

INSERTS FOR AIRFOILS OF GAS TURBINE ENGINES

BACKGROUND

The subject matter disclosed herein generally relates to cooling flow in airfoils of gas turbine engines and, more particularly, to airfoils having modified structure to improve part life.

In gas turbine engines, cooling air may be configured to flow through an internal cavity of an airfoil to prevent overheating. In order to utilize cooling flow efficiently, small cavities that generate high heat transfer are desired. Previously, this has been accomplished using baffles, referred to herein as "space-eater" baffles, to occupy some of the space within the internal cooling cavity and reduce the height and cross-sectional flow area of the internal cavity formed between the baffle wall and the internal surface of the airfoil exterior wall.

These baffles are typically formed into a desired shape by bending and forming sheet metal and, as such, require a minimum bend radius that is approximately two times the sheet metal thickness. In order to maintain the local thermal cooling effectiveness levels needed to achieve optimal thru-wall and in-plane temperature gradients, it becomes desirable to optimize internal convective heat transfer especially adjacent to exterior surfaces that are exposed to high external heat flux. Such locations may be adjacent to an airfoil trailing edge. As such, airfoil cooling configurations incorporating "space-eater" baffles arranged proximate to the airfoil trailing edge can create unique internal convective cooling challenges due to geometric constraints associated with converging internal passage walls and baffle manufacturing geometry limitations.

Cooling passage geometries formed between the "space-eater" baffle and the converging internal surfaces of the exterior walls that define the airfoil trailing edge make it difficult to generate the necessary internal flow vorticities required to produce the required internal convective heat transfer necessary to provide effective thermal cooling. Space-eater baffles generally extend in an aftward direction toward an airfoil trailing edge. The structure of the space-eater baffles will converge as far aft as they can before terminating at a location defined by the minimum manufacturable bend radius due to limitations associated with the thickness of the sheet metal baffle and the forming process. As such, the height and cross-sectional flow area of the internal cooling cavity aft of the baffle is larger than the channel height formed at the converging end/section of the baffle geometry. This abrupt increase in local cavity height and cross-sectional flow area is typically managed through the incorporation and/or modification of local internal convective heat transfer features and/or by increases in the local thickness of the airfoil exterior walls aft of the structure of the baffle.

However, in some arrangements, the baffles may be restricted in an axial extent within an airfoil cavity, resulting in portions of the cooling cavities formed between the space-eater baffle and the airfoil internal surfaces to have relatively large heights and cross-sectional areas, and thus reduced thermal cooling efficiencies. In addition, the rapid change in cavity height from the baffle region to the region aft of the baffle can result in large regions of flow separation, which produce undesirable unstructured wake shedding eddies that induce significant pressure drop. Thus, it is desirable to provide means of controlling the heat transfer and pressure loss in airfoils of gas turbine engines, particularly within airfoils having restricted baffle arrangements.

SUMMARY

According to some embodiments, baffle inserts for airfoils of gas turbine engines are provided. The baffle inserts include a baffle insert body having a first side portion and a second side portion, wherein each side portion has a respective end, a first set of vortex generation elements arranged at the end of the first side portion, and a second set of vortex generation elements arranged at the end of the second side portion. The first set of vortex generation elements and the second set of vortex generation elements are arranged at an aft end of the baffle insert body.

In addition to one or more of the features described above, or as an alternative, further embodiments of the baffle inserts may include that a gap is defined at the aft end of the baffle insert body to allow air to flow aftward through the gap.

In addition to one or more of the features described above, or as an alternative, further embodiments of the baffle inserts may include that the baffle insert body is formed from sheet metal.

In addition to one or more of the features described above, or as an alternative, further embodiments of the baffle inserts may include that each vortex generation element of at least one of the first set of vortex generation elements and the second set of vortex generation elements has a generally square shape.

In addition to one or more of the features described above, or as an alternative, further embodiments of the baffle inserts may include that each vortex generation element of at least one of the first set of vortex generation elements and the second set of vortex generation elements has a generally triangular shape.

In addition to one or more of the features described above, or as an alternative, further embodiments of the baffle inserts may include that each vortex generation element of at least one of the first set of vortex generation elements and the second set of vortex generation elements has a generally rounded shape.

In addition to one or more of the features described above, or as an alternative, further embodiments of the baffle inserts may include that each vortex generation element of at least one of the first set of vortex generation elements and the second set of vortex generation elements has a geometry that is different than at least one other vortex generation element of a respective set of vortex generation elements.

In addition to one or more of the features described above, or as an alternative, further embodiments of the baffle inserts may include that each vortex generation element of the first set of vortex generation elements is welded to the end of the first side portion.

In addition to one or more of the features described above, or as an alternative, further embodiments of the baffle inserts may include that each vortex generation element of at least one of the first set of vortex generation elements and the second set of vortex generation elements includes a twist.

In addition to one or more of the features described above, or as an alternative, further embodiments of the baffle inserts may include that each vortex generation element of at least one of the first set of vortex generation elements and the second set of vortex generation elements is angled relative to a respective side portion.

In addition to one or more of the features described above, or as an alternative, further embodiments of the baffle inserts may include that the vortex generation elements of the first and second sets are defined by a material thickness different than a material thickness of the baffle insert body.

In addition to one or more of the features described above, or as an alternative, further embodiments of the baffle inserts may include that a radial dimension gap is formed between each vortex generation element of the first set of vortex generation elements and each vortex generation element of the second set of vortex generation elements.

In addition to one or more of the features described above, or as an alternative, further embodiments of the baffle inserts may include that the first set of vortex generation elements has a first vortex generation element having a first radial length and a first axial length and a second vortex generation element having a second radial length and a second axial length.

In addition to one or more of the features described above, or as an alternative, further embodiments of the baffle inserts may include that the first radial length and the second radial length are the same and the first axial length and the second axial length are the same.

In addition to one or more of the features described above, or as an alternative, further embodiments of the baffle inserts may include that at least one of (i) the first radial length is different from the second radial length and (ii) the first axial length is different from the second axial length.

In addition to one or more of the features described above, or as an alternative, further embodiments of the baffle inserts may include that the baffle insert body includes a plurality of impingement apertures at a location forward of the aft end of the baffle insert body.

In addition to one or more of the features described above, or as an alternative, further embodiments of the baffle inserts may include that the baffle insert body includes a leading edge portion that defines a leading edge of the baffle insert body.

According to some embodiments, components for gas turbine engines are provided. The components include an airfoil body having a pressure side hot wall and a suction side hot wall that join at a trailing edge of the airfoil body, wherein the airfoil body defines an interior cavity and a baffle insert arranged within the interior cavity of the airfoil body, the baffle insert having a baffle insert body having a first side portion and a second side portion, wherein each side portion has a respective end, a first set of vortex generation elements arranged at the end of the first side portion, and a second set of vortex generation elements arranged at the end of the second side portion, wherein the first set of vortex generation elements and the second set of vortex generation elements are arranged at an aft end of the baffle insert body.

In addition to one or more of the features described above, or as an alternative, further embodiments of the components may include that the baffle insert body includes a plurality of impingement apertures at a location forward of the aft end of the baffle insert body and configured to direct an impinging flow from a baffle cavity onto the pressure side hot wall and the suction side hot wall.

In addition to one or more of the features described above, or as an alternative, further embodiments of the components may include that the airfoil body further includes a trailing edge cavity, wherein the first set of vortex generation elements and the second set of vortex generation elements are arranged forward of the trailing edge cavity and configured to generate a scrubbing flow of cooling air along the pressure side hot wall and the suction side hot wall.

The foregoing features and elements may be combined in various combinations without exclusivity, unless expressly indicated otherwise. These features and elements as well as the operation thereof will become more apparent in light of the following description and the accompanying drawings. It should be understood, however, the following description and drawings are intended to be illustrative and explanatory in nature and non-limiting.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

DETAILED DESCRIPTION

Figure 1:
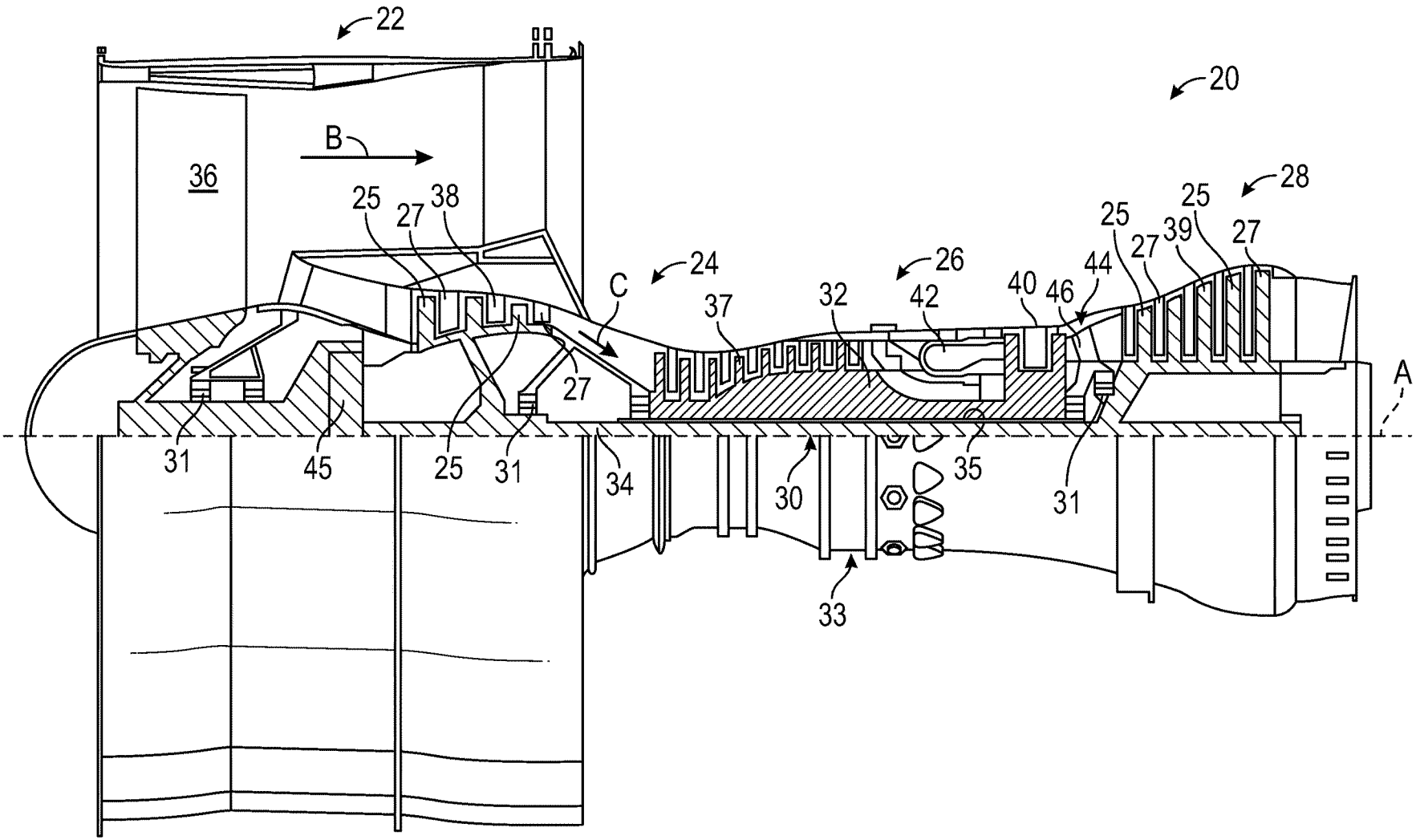
FIG. 1 is a schematic cross-sectional view of a gas turbine engine that may employ various embodiments disclosed herein.

FIG. 1 schematically illustrates a gas turbine engine 20. The exemplary gas turbine engine 20 is a two-spool turbofan engine that generally incorporates a fan section 22, a compressor section 24, a combustor section 26, and a turbine section 28. The fan section 22 drives air along a bypass flow path B, while the compressor section 24 drives air along a core flow path C for compression and communication into the combustor section 26. Hot combustion gases generated in the combustor section 26 are expanded through the turbine section 28. Although depicted as a turbofan gas turbine engine in the disclosed non-limiting embodiment, it should be understood that the concepts described herein are not limited to turbofan engines and these teachings could extend to other types of engines, as will be appreciated by those of skill in the art.

The gas turbine engine 20 generally includes a low speed spool 30 and a high speed spool 32 mounted for rotation about an engine centerline longitudinal axis A. The low speed spool 30 and the high speed spool 32 may be mounted relative to an engine static structure 33 via several bearing systems 31. It should be understood that other bearing systems 31 may alternatively or additionally be provided.

The low speed spool 30 generally includes an inner shaft 34 that interconnects a fan 36, a low pressure compressor 38 and a low pressure turbine 39. The inner shaft 34 can be connected to the fan 36 through a geared architecture 45 to drive the fan 36 at a lower speed than the low speed spool 30. The high speed spool 32 includes an outer shaft 35 that interconnects a high pressure compressor 37 and a high pressure turbine 40. In this embodiment, the inner shaft 34 and the outer shaft 35 are supported at various axial locations by bearing systems 31 positioned within the engine static structure 33.

A combustor 42 is arranged between the high pressure compressor 37 and the high pressure turbine 40. A mid-turbine frame 44 may be arranged generally between the high pressure turbine 40 and the low pressure turbine 39. The mid-turbine frame 44 can support one or more bearing systems 31 of the turbine section 28. The mid-turbine frame 44 may include one or more airfoils 46 that extend within the core flow path C.

The inner shaft 34 and the outer shaft 35 are concentric and rotate via the bearing systems 31 about the engine centerline longitudinal axis A, which is co-linear with their longitudinal axes. The core airflow is compressed by the low pressure compressor 38 and the high pressure compressor 37, is mixed with fuel and burned in the combustor 42, and is then expanded over the high pressure turbine 40 and the low pressure turbine 39. The high pressure turbine 40 and the low pressure turbine 39 rotationally drive the respective high speed spool 32 and the low speed spool 30 in response to the expansion.

The pressure ratio of the low pressure turbine 39 can be pressure measured prior to the inlet of the low pressure turbine 39 as related to the pressure at the outlet of the low pressure turbine 39 and prior to an exhaust nozzle of the gas turbine engine 20. In one non-limiting embodiment, the bypass ratio of the gas turbine engine 20 is greater than about ten (10:1), the fan diameter is significantly larger than that of the low pressure compressor 38, and the low pressure turbine 39 has a pressure ratio that is greater than about five (5:1). It should be understood, however, that the above parameters are only examples of one embodiment of a geared architecture engine and that the present disclosure is applicable to other gas turbine engines, including direct drive turbofans.

In this embodiment of the example gas turbine engine 20, a significant amount of thrust is provided by the bypass flow path B due to the high bypass ratio. The fan section 22 of the gas turbine engine 20 is designed for a particular flight condition—typically cruise at about 0.8 Mach and about 35,000 feet. This flight condition, with the gas turbine engine 20 at its best fuel consumption, is also known as bucket cruise Thrust Specific Fuel Consumption (TSFC). TSFC is an industry standard parameter of fuel consumption per unit of thrust.

Fan Pressure Ratio is the pressure ratio across a blade of the fan section 22 without the use of a Fan Exit Guide Vane system. The low Fan Pressure Ratio according to one non-limiting embodiment of the example gas turbine engine 20 is less than 1.45. Low Corrected Fan Tip Speed is the actual fan tip speed divided by an industry standard temperature correction of $[(T_{ram}° R)/(518.7° R)]^{0.5}$, where T represents the ambient temperature in degrees Rankine. The Low Corrected Fan Tip Speed according to one non-limiting embodiment of the example gas turbine engine 20 is less than about 1150 fps (351 m/s).

Each of the compressor section 24 and the turbine section 28 may include alternating rows of rotor assemblies and vane assemblies (shown schematically) that carry airfoils that extend into the core flow path C. For example, the rotor assemblies can carry a plurality of rotating blades 25, while each vane assembly can carry a plurality of vanes 27 that extend into the core flow path C. The blades 25 of the rotor assemblies create or extract energy (in the form of pressure) from the core airflow that is communicated through the gas turbine engine 20 along the core flow path C. The vanes 27 of the vane assemblies direct the core airflow to the blades 25 to either add or extract energy.

Various components of a gas turbine engine 20, including but not limited to the airfoils of the blades 25 and the vanes 27 of the compressor section 24 and the turbine section 28, may be subjected to repetitive thermal cycling under widely ranging temperatures and pressures. The hardware of the turbine section 28 is particularly subjected to relatively extreme operating conditions. Therefore, some components may require internal cooling circuits for cooling the parts during engine operation. Example cooling circuits that include features such as partial cavity baffles are discussed below.

Figure 2:
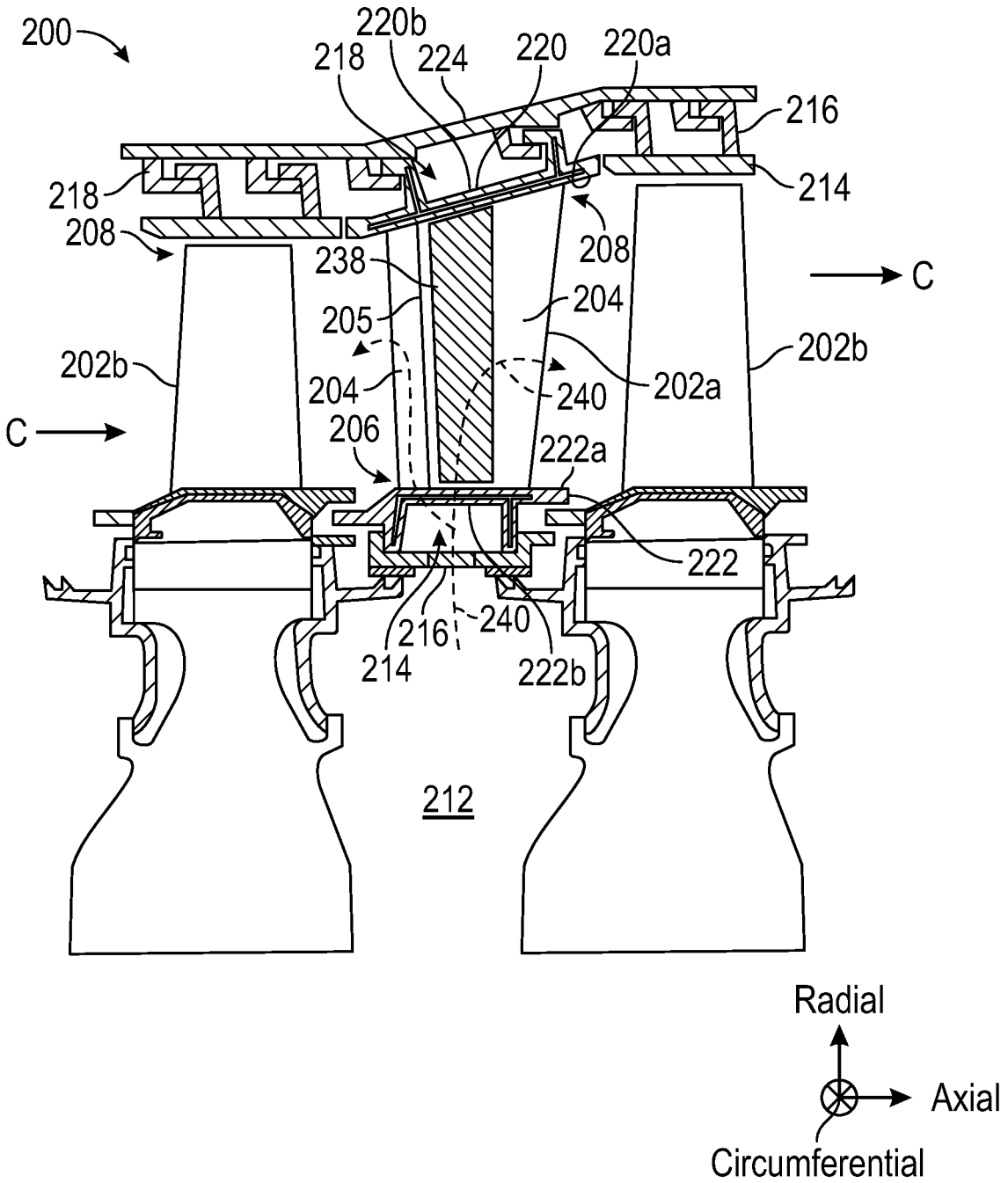
FIG. 2 is a partial schematic view of a portion of a turbine section of a gas turbine engine of that may employ various embodiments of the present disclosure.

FIG. 2 is a partial schematic view of a turbine section 200 that may be part of a gas turbine engine as shown and described above. Turbine section 200 includes one or more airfoils 202*a*, 202*b*. As shown, some airfoils 202*a* are stationary stator vanes and other airfoils 202*b* are blades of turbines disks. The airfoils 202*a*, 202*b*, in accordance with embodiments of the present disclosure, are hollow body airfoils with one or more internal cavities 204 defining respective cooling channels (schematically shown in vane 202*a*). The airfoil cavities 204 are formed within the airfoils 202*a*, 202*b* and extend from an inner diameter 206 to an outer diameter 208, or vice-versa. The airfoil cavities 204, as shown in the vane 202*a*, may be separated by partitions 205 that extend along a radial direction of the respective airfoil, e.g., from the inner diameter 206 or the outer diameter 208 of the vane 202*a*. Those of skill in the art will appreciate that the partitions 205 that separate and define the airfoil cavities 204 are not usually visible and FIG. 2 is merely presented for illustrative and explanatory purposes. Although not shown, those of skill in the art will appreciate that the blades 202*b* can include similar cooling passages formed by partitions therein.

The airfoil cavities 204 are configured for cooling airflow to pass through portions of the vane 202*a* and thus cool the vane 202*a*. For example, as shown in FIG. 2, an airflow path 240 is indicated by a dashed line. In the configuration of FIG. 2, air flows from a rotor cavity 212 and into an airfoil inner diameter cavity 214 through an orifice 216. The air then flows into and through the airfoil cavities 204 as indicated by the airflow path 240. Positioned at the outer diameter of the vane 202*a*, as shown, is an outer diameter cavity 218. Although shown with the airflow path 240 originating at an inner diameter, those of skill in the art will appreciate that a cooling airflow can be supplied from an outer diameter (e.g., from the outer diameter cavity 218) or from a combination of inner and outer diameter cavities.

As shown in FIG. 2, the vane 202*a* includes an outer diameter platform 220 and an inner diameter platform 222. The platforms 220, 222 are configured to enable attachment within and to the gas turbine engine. For example, as appreciated by those of skill in the art, the inner diameter platform 222 can be mounted between adjacent rotor disks and the outer diameter platform 220 can be mounted to a case 224 of the gas turbine engine.

As shown, the outer diameter cavity 218 is formed between the case 224 and the outer diameter platform 220. Those of skill in the art will appreciate that the outer diameter cavity 218 and the inner diameter cavity 214 are outside of or separate from a core flow path C (e.g., a hot gas path). The cavities 214, 218 are separated from the core flow path C by the platforms 220, 222. Thus, each platform 220, 222 includes a respective core gas path surface 220*a*, 222*a* and a non-gas path surface 220*b*, 222*b*.

A body of the vane 202*a*, which defines the airfoil cavities 204 therein and forms the shape and exterior surfaces of the vane 202*a* extends from and between the gas path surfaces 220*a*, 222*a* of the respective platforms 220, 222. In some embodiments, the platforms 220, 222 and the body of the vane 202*a* are formed as a unitary body or structure. In other embodiments, the vane body may be attached to the platforms, as will be appreciated by those of skill in the art.

Air is passed through the cavities of the airfoils to provide cooling airflow to prevent overheating of the airfoils and/or other components or parts of the gas turbine engine. The flow rate through the airfoil cooling cavities may be a relatively low flow rate of air and, as such, the internal velocity and corresponding Reynolds number of the internal cooling air will in turn be relatively low, thereby resulting in poor flow quality and significantly reduced convective cooling characteristics. The resulting internal convective heat transfer coefficients may be too low to achieve desired local metal temperatures of the airfoil exterior walls in order to meet durability oxidation, creep, and thermal mechanical fatigue life goals. One solution to address the low flow rate within the airfoil cavities is to add one or more baffles 238 into the airfoil cavities. That is, in order to achieve desired metal temperatures to meet airfoil full-life with the cooling flow allocated based on turbine engine design, performance, efficiency, and fuel consumption requirements, "space-eater" baffles 238 may be used inside airfoil cooling passages (e.g., within the airfoil cavities 204 shown in FIG. 2).

The "space-eater" baffle serves as a way to consume internal cavity area/volume in order to reduce the available cross-sectional area through which cooling air can flow. This enables the local flow per unit area to be increased which in turn results in higher cooling cavity Reynolds Numbers and internal convective heat transfer. In some circumstances, depending upon the method of manufacture, the radial cooling cavities 204 must be accessible to allow for the insertion of the "space-eater" baffles. However, those of skill in the art will appreciate that if the airfoil cooling configurations are fabricated using alternative additive manufacturing processes and/or fugitive core casting processes the "space-eater" baffles may be fabricated as an integral part or component of the internal convective cooling design concurrently with the rest of the core body and cooling circuit.

Figure 3A:
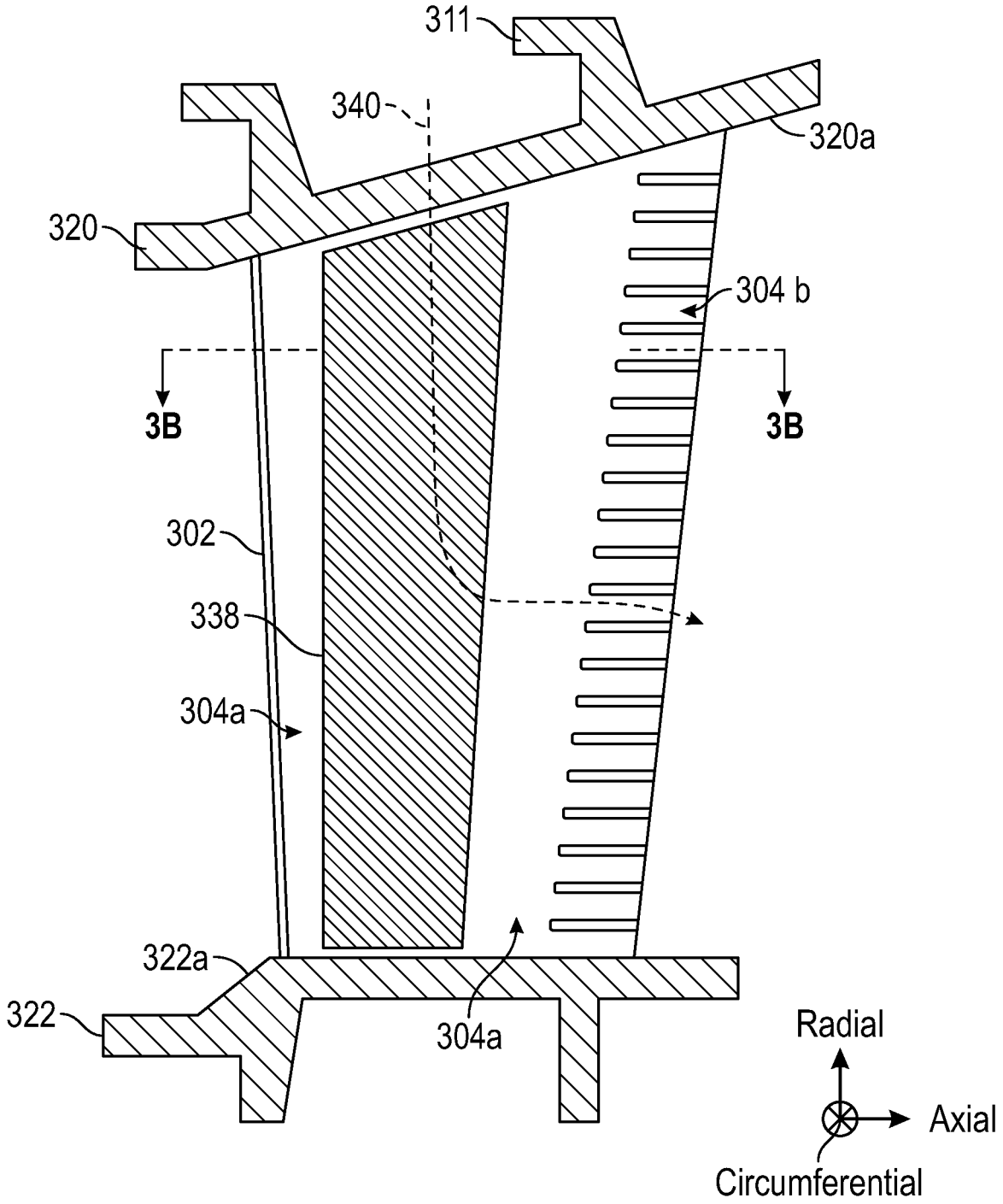
FIG. 3A is a schematic illustration of an airfoil that may incorporate embodiments of the present disclosure.
Figure 3B:
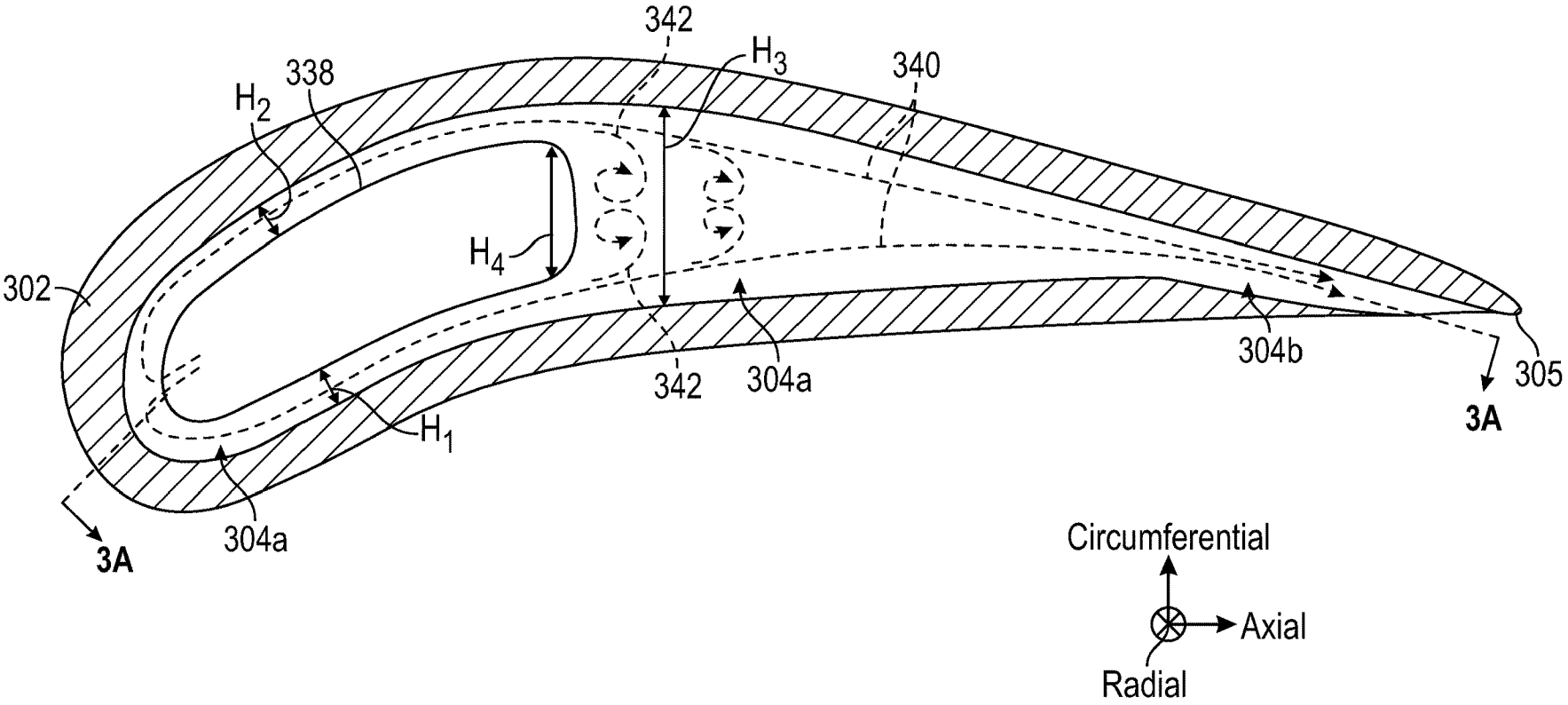
FIG. 3B is a cross-sectional illustration of the airfoil of FIG. 3A as viewed along the line 3B-3B thereof.

Turning now to FIGS. 3A-3B, schematic illustrations of an airfoil 302 that can incorporate embodiments of the present disclosure are shown. FIG. 3A is a cross-sectional view of the airfoil 302 viewed along the 3A-3A shown in FIG. 3B, and FIG. 3B is a cross-sectional view of the airfoil 302 viewed along the line 3B-3B shown in FIG. 3A. The airfoil 302 may be a blade or vane and, similar to that shown and described above, includes an airfoil body that extends from an inner diameter platform 322 to an outer diameter platform 320. Specifically, the body of the airfoil 302 extends from a gas path surface 320*a* of the outer diameter platform 320 to a gas path surface 322*a* of the inner diameter platform 322.

The airfoil 302 includes one or more interior airfoil cavities, as shown having an airfoil cavity 304*a* fluidly connected to a trailing edge cavity 304*b*. As illustratively depicted in FIGS. 3A-3B, the flow of cooling air can follow an airflow path 340 by entering the airfoil 302 from the outer diameter and out through the trailing edge cavity 304*b*. As shown, the airfoil cavity 304*a* is configured with a baffle 338 inserted therein.

During part assembly, baffles must be inserted into the interior airfoil cavities via the inner diameter or the outer diameter, e.g., through openings at ends of the airfoil body. Typically, the vane rails (e.g., for connecting to a case of a gas turbine engine) may inhibit insertion of the baffles which can limit an axial length of the baffle. For example, the aft length (or axial extent) of a baffle may be constrained by the presence of an outer diameter rail 311.

It will be appreciated that the aft pressure side, aft suction side, and trailing edge portions of an airfoil are often the hottest locations and need sufficient cooling to ensure part life and operation. The use of a baffle insert, as described above, is a common way to supply internal cooling to the airfoil. Such baffles or inserts are a thin-walled metallic components that are placed inside an airfoil cavity that increase the convective heat transfer either by using impingement jets or by consuming space within the internal cooling cavity in order to increase the internal cooling air flow velocity and Reynolds numbers. However, due to size and dimensional constraints, most baffle inserts cannot fully extend and reach the aft of the cavity and provide adequate internal convective cooling where it is needed most, such as shown in FIG. 3B. Additionally, many airfoils with thermally challenged trailing edges use discharge cooling holes, slots, and other air flow apertures, that feed from the aft of the airfoil cavity and exit on the airfoil trailing edge to aid in the convective cooling of the local aft portion and the trailing edge of the airfoil region by convecting heat from the hot exterior airfoil walls into the internal working cooling air flow fluid. In this sense, these trailing edge discharge holes, slots, and/or flow apertures pull flow from inside the airfoil cavities in a predominantly axial direction toward the aft trailing edge.

As can be seen in FIG. 3B, which is a cross-sectional view of FIG. 3A as viewed along the line 3B-3B, a cooling cavity height is controlled by the baffle-to-airfoil-wall offsets $H_1$, $H_2$, with smaller heights being preferable. However, when a rail, such as outer diameter rail 311, prevents a full axial-length baffle, the trailing edge of the baffle becomes blunt, creating a large baffle trailing edge height $H_4$. This, in turn, creates a height of the cooling passage aft of the baffle $H_3$ that is very large because it is no longer constrained by the baffle and is merely an open airfoil cavity with the height of the cavity defined by opposing airfoil walls (e.g., no baffle to shorten the height), resulting in reduced heat transfer. In addition, the rapid change in cavity height from the baffle region $H_1$, $H_2$ to the region aft of the baffle $H_3$ can result in large regions of flow separation which produce undesirable unstructured wake shedding eddies 342 immediately downstream of the baffle that induce significant pressure loss.

Embodiments of the present disclosure are directed to adding flow turbulation or vortex generation elements to the aft-end of a baffle to increase the heat transfer in the region after the baffle ends and before the trailing edge discharge begins (e.g., transition between the airfoil cavity 304*a* and the trailing edge cavity 304*b* shown in FIG. 3B). The vortex generation elements of the present disclosure are features that are integral parts or attached to a baffle insert. The vortex generation elements may be formed of interlocking structures (e.g., fins, plates, tabs, etc.) that protrude from the end of the baffle. The height, length, shape, surface contour, angle, and twist of the vortex generation elements may vary depending on dimensional constraints in a specific geometry cavity and the convective cooling needs of a specific airfoil design configuration. As the cooling air flowing toward the trailing edge discharge travels along and around the vortex generation elements, rotating vortices are formed that generate levels of high local turbulence and turbulence intensity which enhance local mixing characteristics and the internal convective heat transfer along the internal surfaces of exterior airfoil cavity walls. The enhancement in local heat transfer coefficients achieved from the vortex generation elements provides improved cooling characteristics that promote improved internal convection from the hot exterior airfoil walls into the working fluid or cooling fluid. The increased rate of heat transfer from the internal surfaces of the hot exterior airfoil walls results in additional cooling air heat pickup, thereby improving the local convective efficiency and local thermal cooling effectiveness resulting in reduced local operating airfoil temperatures and improved durability life capability.

Figure 4:
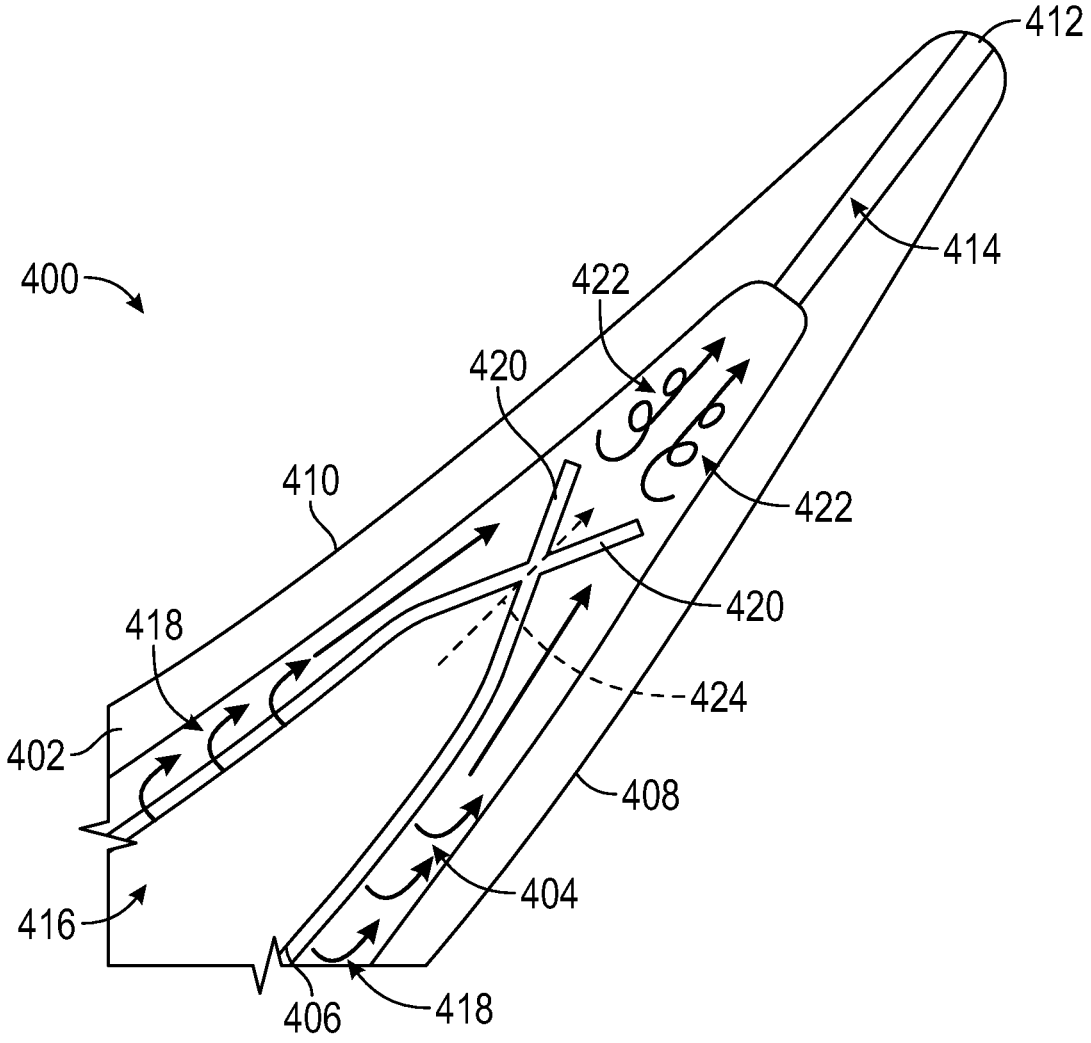
FIG. 4 is a schematic illustration of a component assembly of a gas turbine engine in accordance with an embodiment of the present disclosure.

Turning now to FIG. 4, a schematic illustration of an airfoil assembly 400 in accordance with an embodiment of the present disclosure is shown. The airfoil assembly 400 may be used in gas turbine engines, as described above, and may be a vane or blade. The airfoil assembly 400 includes an airfoil body 402 defining an interior cavity 404 and a baffle insert 406 arranged within the interior cavity 404. The airfoil body 402 has a pressure side hot wall 408 and a suction side hot wall 410 that join at a trailing edge 412 of the airfoil body 402. The interior cavity 404 fluidly connects to a trailing edge cavity 414 which is configured to expel cooling air out the trailing edge 412 of the airfoil body 402.

The baffle insert 406 defines a baffle cavity 416 configured to receive a cooling flow to be distributed into the interior cavity 404 of the airfoil body 402. For example, as shown, an impingement flow 418 may exit the baffle cavity 416 and impinge upon the pressure side hot wall 408 and the suction side hot wall 410 of the airfoil body 402 and then flow aftward toward the trailing edge 412. The baffle insert 406 includes vortex generation elements 420 at an aft end thereof. The vortex generation elements 420 are configured and arranged to generate a vortex flow 422 of cooling air as the flow enters a volume downstream of the baffle insert 406 and upstream of the trailing edge cavity 414. The vortex flow 422 may be formed off the ends of each set of vortex generation elements 420 and cause a turbulent flow of air that will increase local cooling flow vortices and promote enhanced internal convective cooling, resulting from improved near-wall mixing within a thermal boundary layer along the internal airfoil wall surfaces. As such, the local heat transfer coefficients are enhanced which enable a higher rate of heat to be extracted from the internal surfaces of the material that forms the hot exterior walls of the pressure side hot wall 408 and the suction side hot wall 410 downstream or aft of the baffle insert 406. Similarly, this scrubbing action will cause an increase in the extraction of heat from the airfoil pressure side hot wall 408 and the airfoil suction side hot wall 410 and provide a cooling function thereto.

The vortex generation elements 420 are formed as part of the baffle insert 406 and may be manufactured from the same material and even same sheet of metal that is used to form the baffle insert 406. The vortex generation elements 420 may be tabs or other types of structures that extend from an end of the baffle insert 406. The illustration of FIG. 4 is a top-down view, illustrating the vortex generation elements 420 as a pseudo-X geometry. However, such illustration omits depth, and the vortex generation elements 420 are arranged in an alternating manner, as shown and described below. As shown, in addition to the impingement flow 418 that may pass through impingement holes in the material of the baffle insert 406, spacing within the aft end of the baffle insert 406 and/or between adjacent vortex generation elements 420 may enable an aft cooling flow 424 to be employed.

Figure 5A:
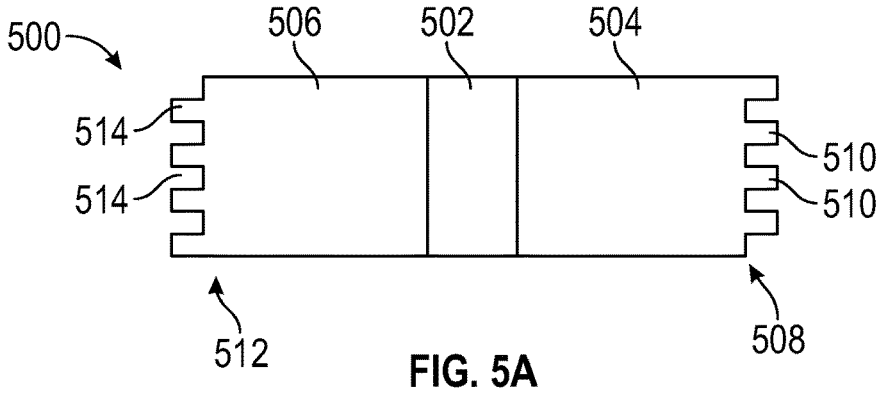
FIG. 5A is a schematic illustration of a baffle insert in accordance with an embodiment of the present disclosure, illustrated prior to assembly.
Figure 5B:
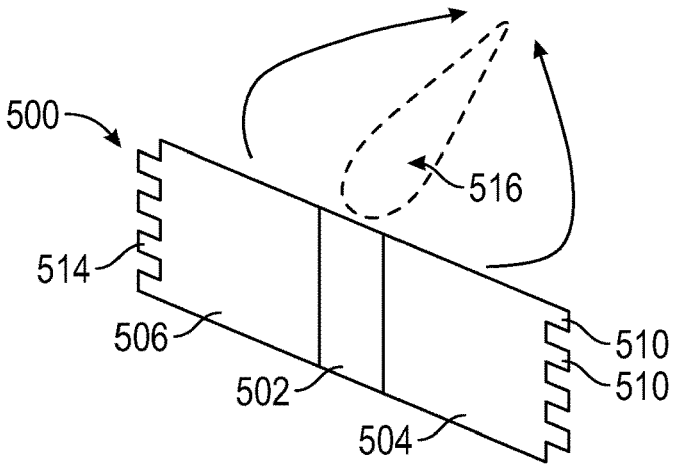
FIG. 5B illustrates an assembly process of the baffle insert of FIG. 5A.
Figure 5C:
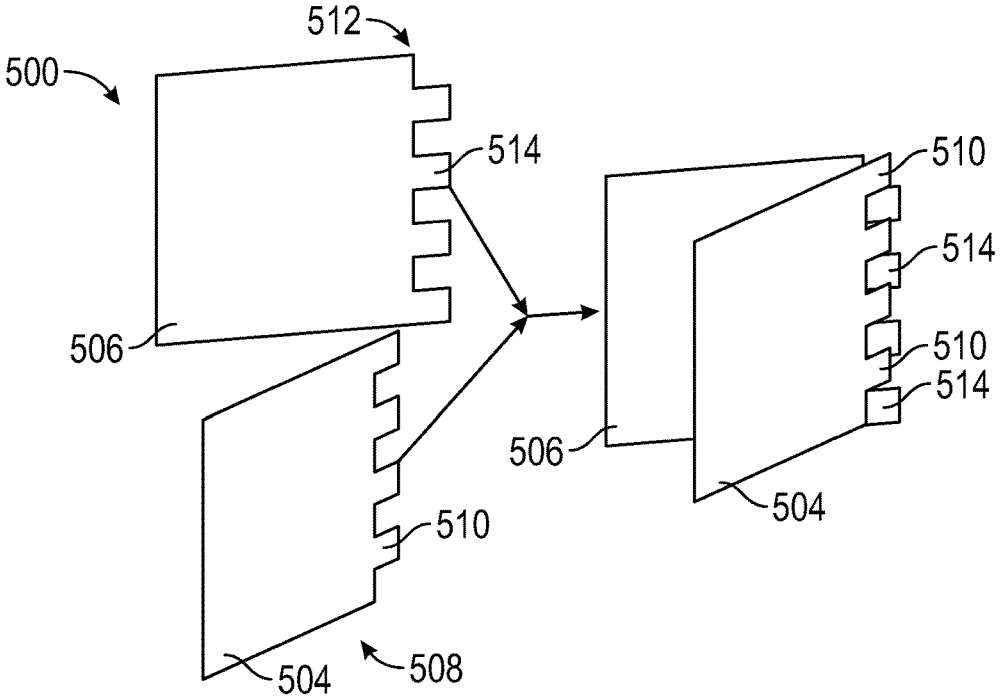
FIG. 5C illustrates an enlarged view of a part of the assembly process of the baffle insert of FIG. 5A.

Turning now to FIGS. 5A-5C, schematic illustrations of a baffle insert 500 in accordance with an embodiment of the present disclosure are shown. The baffle insert 500 illustrates one configuration for formation of vortex generation elements in accordance with the present disclosure. FIG. 5A illustrates the baffle insert 500 in sheet form, FIG. 5B illustrates the process of forming the baffle insert 500 into a final assembly, and FIG. 5C illustrates the nature of the vortex generation elements as arranged as part of an assembled baffle insert.

As shown in FIG. 5A, the baffle insert 500 comprises various different portions, including a leading edge portion 502, a first side portion 504, and a second side portion 506. The first side portion 504 may be formed to define a pressure side oriented wall of a formed baffle insert 500 and the second side portion 506 may be formed to define a suction side oriented wall of a formed baffle insert 500. Each of the leading edge portion 502, the first side portion 504, and the second side portion 506 may include holes or apertures that define through-holes through the material of the baffle insert 500 to enable impingement cooling when installed in an airfoil body and in operation. At an end 508 of the first side portion 504 is a first set of vortex generation elements 510. Similarly, at an end 512 of the second side portion 506 is a second set of vortex generation elements 514. As shown, the vortex generation elements 510, 514 are extensions of the material of the first side portion 504 and the second side portion 506, respectively. In some embodiments, the portions 502, 504, 506 of the baffle insert 500 may be a single continuous materials (e.g., a cut or punched sheet metal structure), and thus the various portions may be arbitrary in location and are merely named and indicative of the final formed structure or assembled baffle insert.

FIG. 5B illustrates the bending or forming of the baffle insert 500 into a baffle shape or form. When the first side portion and the second side portion are bent or folded back as indicated by the curved arrows, a baffle cavity 516 will be defined within the portions 502, 504, 506 of the baffle insert 500. As the ends 508, 512 are joined together, the vortex generation elements 510, 514 will form an alternating or overlapping pattern, as shown in FIG. 5C.

In operation, as a cooling flow of air exits the baffle cavity 516 and flows aftward or toward the ends 508, 512 of the baffle insert 500, the cooling flow of air will interact with the vortex generation elements 510, 514. Such interaction will cause the cooling flow of air to become turbulent. However, in contrast to the turbulence generated by a conventional baffle insert configuration (e.g., as shown in FIG. 3B), the vortex generation elements 510, 514 direct a portion of the turbulent air against or along the interior surfaces of the hot walls of the airfoil. Such directed turbulent air will increase local internal cooling flow vortices and promote enhanced internal convective cooling, resulting from improved near-wall mixing within the thermal boundary layer. As such, the local heat transfer coefficients are enhanced which cause a higher rate of heat to be extracted from the internal surfaces of the material that forms the hot exterior airfoil walls, and such cooling air will then be expelled through a trailing edge cavity of an airfoil body.

The illustration of FIGS. 5A-5C is merely illustrative and not to be limiting. The shape, size, geometry, orientation, and other defining characteristics of the vortex generation elements of the present disclosure may take various different forms (e.g., shapes, sizes, and orientations). For example, turning to FIGS. 6-9, schematic illustrations of different types of geometric profiles of the vortex generation elements of the present disclosure are shown.

Figure 6:
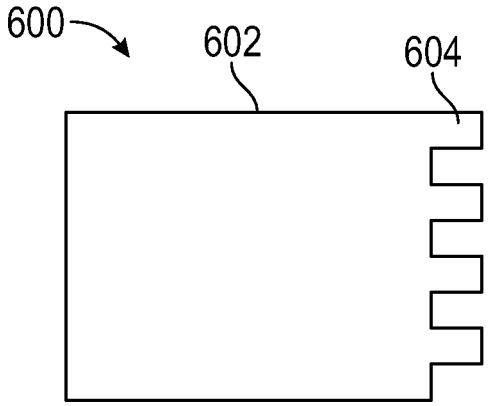
FIG. 6 is a schematic illustration of features of a baffle insert in accordance with an embodiment of the present disclosure.
Figure 7:
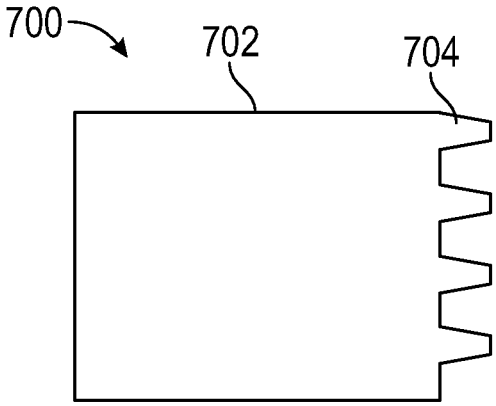
FIG. 7 is a schematic illustration of features of a baffle insert in accordance with an embodiment of the present disclosure.
Figure 8:
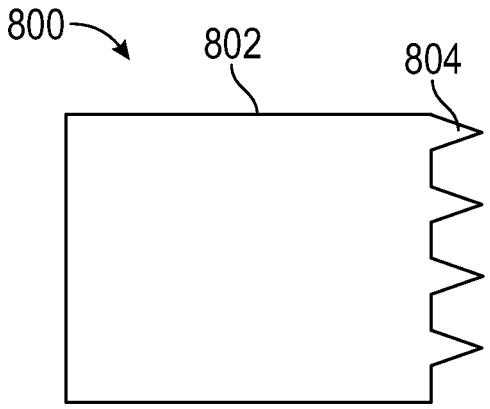
FIG. 8 is a schematic illustration of features of a baffle insert in accordance with an embodiment of the present disclosure.
Figure 9:
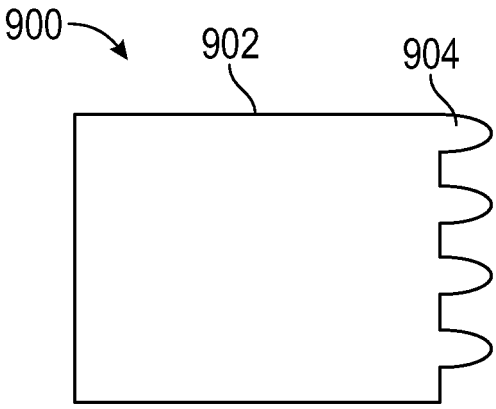
FIG. 9 is a schematic illustration of features of a baffle insert in accordance with an embodiment of the present disclosure.

FIG. 6 illustrates a portion 602 of a baffle insert 600 having generally square or rectangular shape vortex generation elements 604. FIG. 7 illustrates a portion 702 of a baffle insert 700 having generally trapezoidal or polygonal shaped vortex generation elements 704. FIG. 8 illustrates a portion 802 of a baffle insert 800 having generally triangular shaped vortex generation elements 804. FIG. 9 illustrates a portion 902 of a baffle insert 900 having generally rounded, circular, or oval shaped vortex generation elements 904. FIGS. 6-9 are illustrative of various different example geometries, and are not intended to be limiting, but are provided for example and illustrative purposes.

Although shown above as having substantially uniform vortex generation elements along an end of the portions of the baffle inserts, such uniform nature is not to be limiting. For example, turning to FIG. 10, a schematic illustration of a portion 1002 of a baffle insert 1000 having rectangular or square shaped vortex generation elements 1004, 1006 is shown. In this illustrative embodiment, the portion 1002 includes two different configurations of vortex generation elements 1004, 1006. In this configuration, a first vortex generation element 1004 has a respective first radial length $L_{R1}$ and a first axial length $L_{A1}$ and a second vortex generation element 1006 has a respective second radial length $L_{R2}$ and a second axial length $L_{A2}$. In this illustration, the axial and radial directions or dimensions are with respect to a formed and assembled baffled insert as it would be oriented when installed within an airfoil. The arrangement of different vortex generation elements 1004, 1006 may be repetitive in fashion (e.g., alternating as shown) or may be in an arranged to generate a desired cooling scheme in a specific airfoil. For example, a shortening or lessening in one or both of the axial length and the radial length along a radial extent of the formed baffle insert may be desired (or the alternative of increasing of one or both of the lengths). These dimensions may also be applicable to other geometric shapes, such as those shown and described with respect to FIGS. 6-9.

Figure 10:
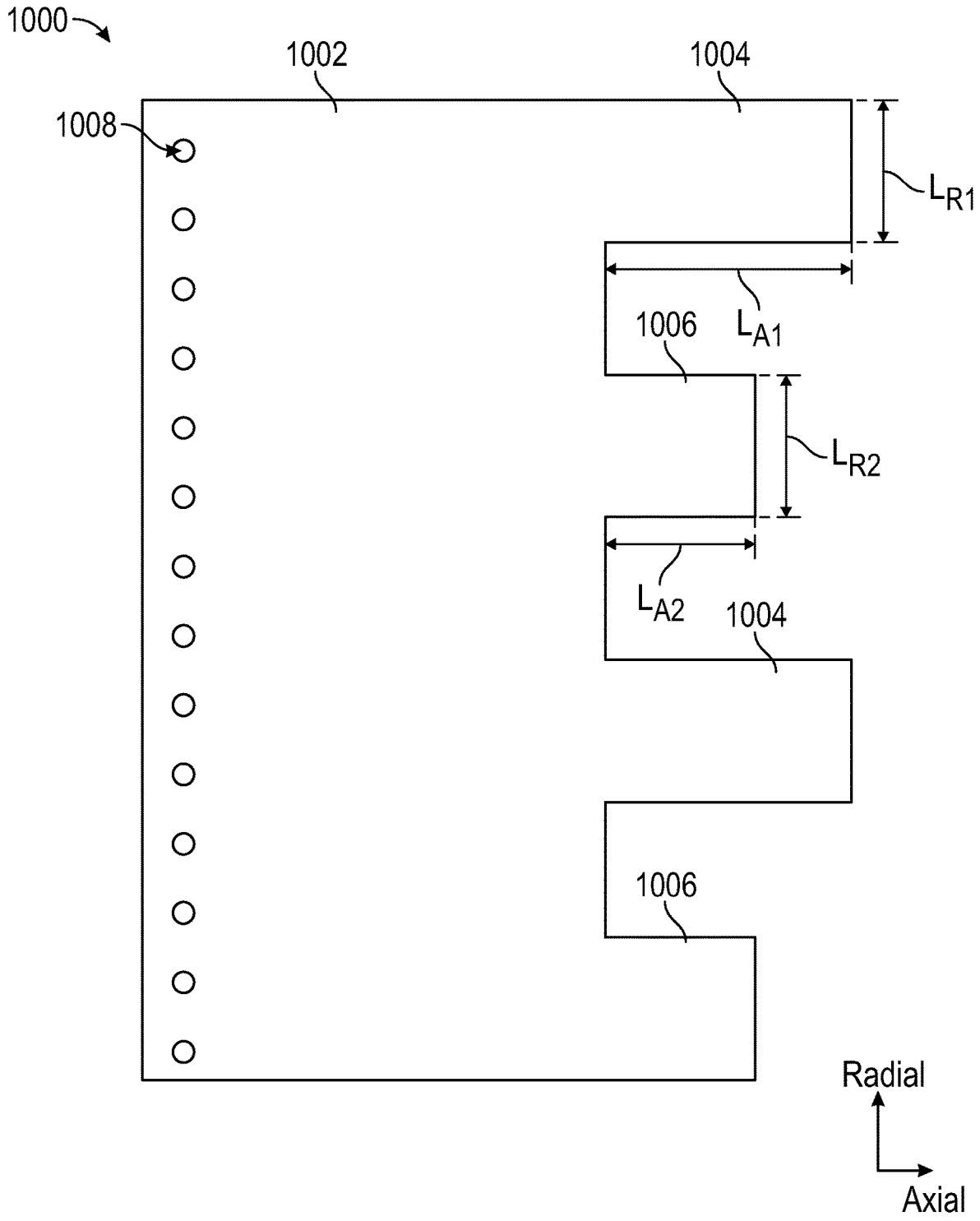
FIG. 10 is a schematic illustration of features of a baffle insert in accordance with an embodiment of the present disclosure.

Also shown in FIG. 10 are a plurality of impingement apertures 1008 arranged in the material of the baffle insert 1000. The impingement apertures 1008 allow for a cooling fluid within a baffle cavity to exit through the impingement apertures 1008 and impinge upon a hot wall of an airfoil body. The impinging air will then travel aftward toward a trailing edge of the airfoil body. As the cooling air travels aftward, the cooling air will interact with the vortex generation elements 1004, 1006 to increase local cooling flow vortices and promote enhanced internal convective cooling, resulting from improved near-wall mixing within the thermal boundary layer along the internal airfoil wall surfaces. As such the local heat transfer coefficients are enhanced which cause a higher rate of heat to be extracted from the internal surfaces of the material forming the hot exterior airfoil walls. Similarly, this scrubbing action will enable an increase in the extraction of heat from the airfoil pressure side hot wall and the airfoil suction side hot wall and provide a cooling function thereto.

Figure 11A:
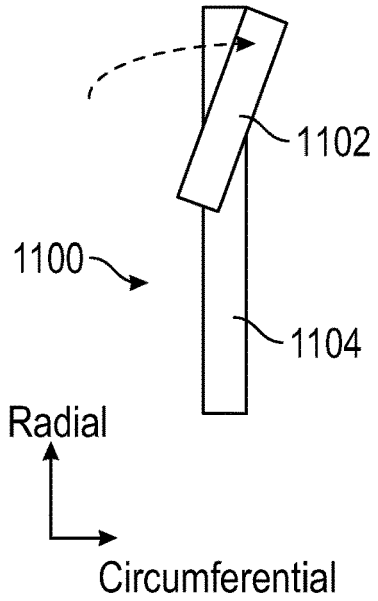
FIG. 11A is a schematic elevation illustration of features of a baffle insert in accordance with an embodiment of the present disclosure.
Figure 11B:
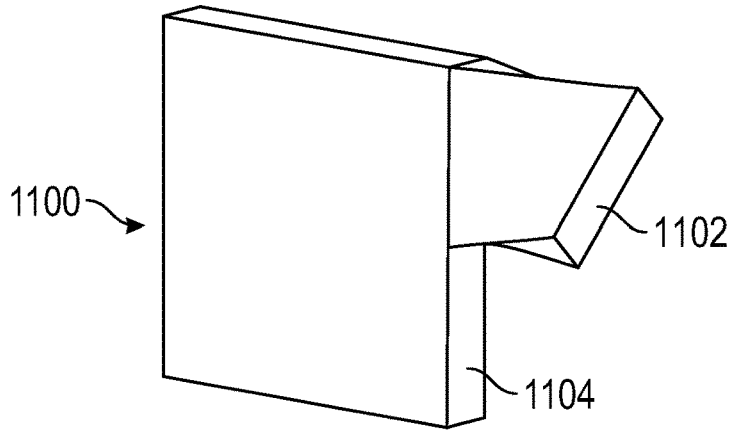
FIG. 11B is a schematic isometric illustration of the features shown in FIG. 11A.

In addition to different geometric profiles, as shown in FIGS. 6-10, the vortex generation elements of the present disclosure may include various other characteristics, including, without limitation, twists, bend angles, curves, etc. For example, FIGS. 11A-11B illustrate a vortex generation element 1102 as part of a baffle insert 1100. The vortex generation element 1102 include a twist as the vortex generation element 1102 extends from an end 1104 of the baffle insert 1100. The illustration of FIG. 11A is end on viewed from aft to forward and FIG. 11B is an isometric illustration of the baffle insert 1100 and twisted vortex generation element 1102. In some embodiments, the twist may be achieved as a rotation or twist about a radial centerline passing through the respective vortex generation element 1102. Such twisting vortex generation elements may be fabricated directly through additive manufacturing processes, fugitive core casting processes, sheet metal forming processes, and/or manually by engagement with and rotation by conventional handheld tools and/or alternative gripping tools.

Figure 12:
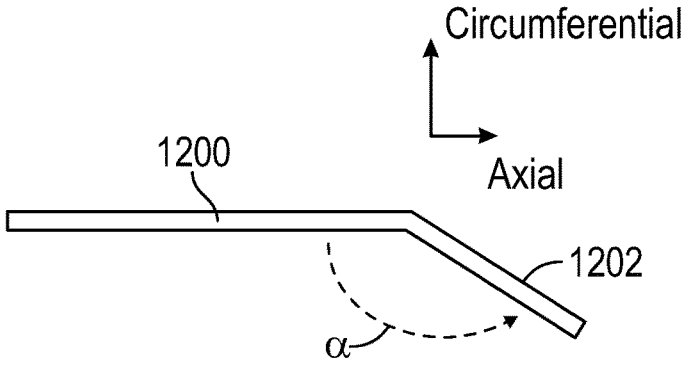
FIG. 12 is a schematic illustration of features of a baffle insert in accordance with an embodiment of the present disclosure.
Figure 13:
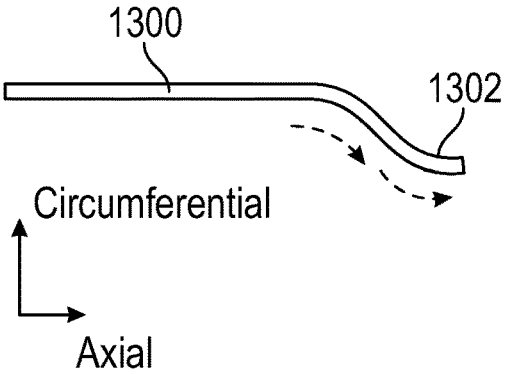
FIG. 13 is a schematic illustration of features of a baffle insert in accordance with an embodiment of the present disclosure.
Figure 14:
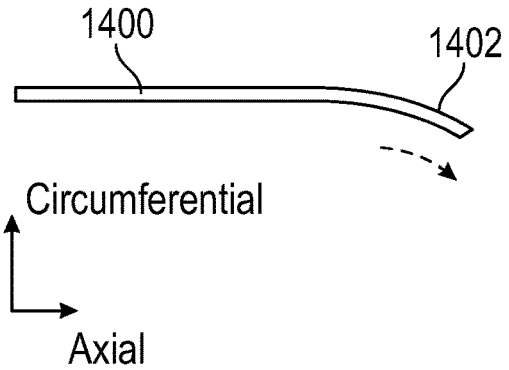
FIG. 14 is a schematic illustration of features of a baffle insert in accordance with an embodiment of the present disclosure.

FIG. 12 illustrates a vortex generation element 1202 that is bent at an angle $\alpha$ relative to the baffle insert 1200. FIG. 12 is a top down or radially inward view of the baffle insert 1200. FIGS. 13 and 14 illustrate curved vortex generation elements 1302, 1402, respectively, which are curved relative to a respective baffle insert 1300, 1400. FIGS. 13 and 14 are top down or radially inward views of the baffle inserts 1300, 1400.

Figure 15:
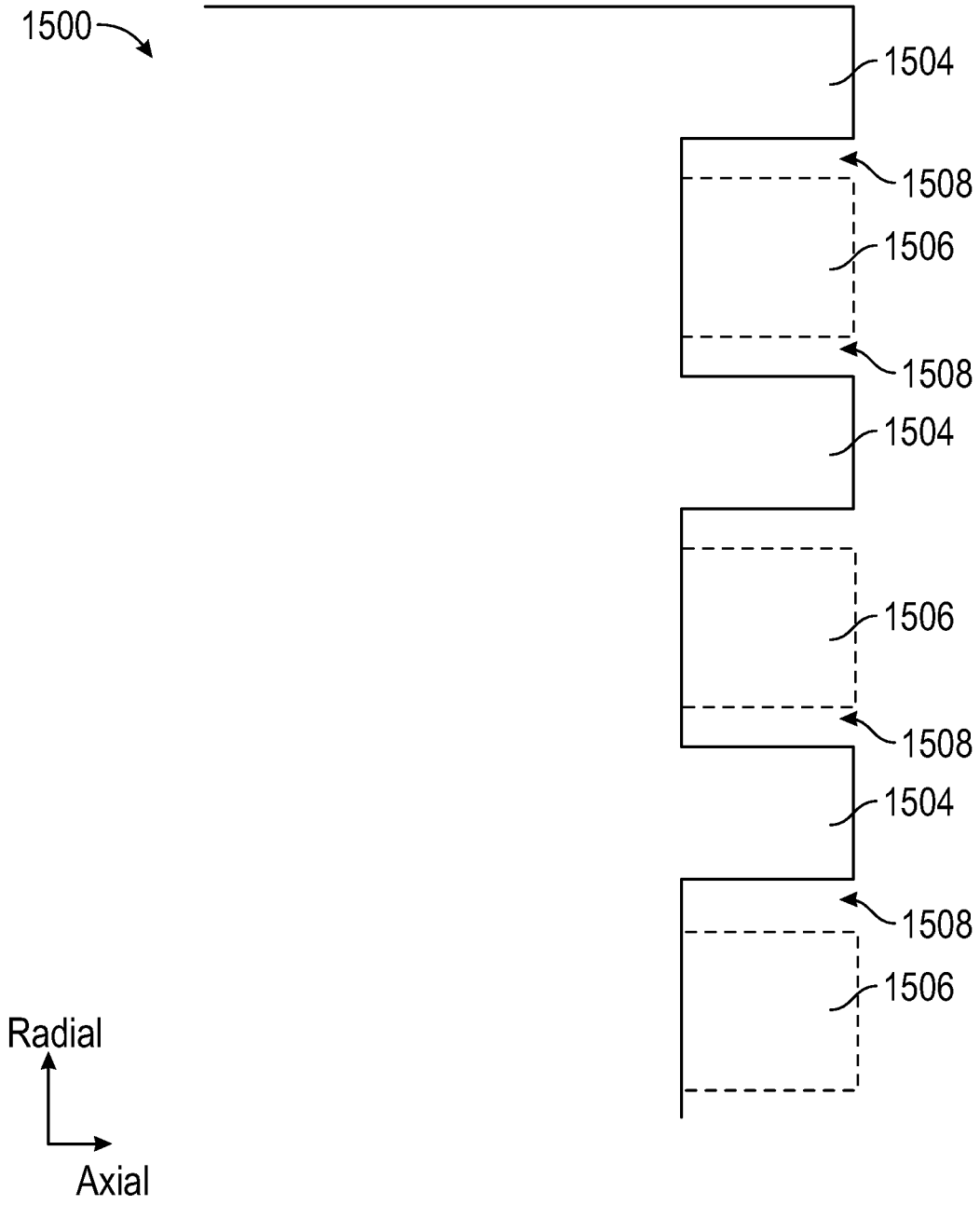
FIG. 15 is a schematic illustration of features of a baffle insert in accordance with an embodiment of the present disclosure.

Turning now to FIG. 15, a schematic illustration of a baffle insert 1500 a first set of vortex generation elements 1504 and a second set of vortex generation elements 1506 is shown. The first set of vortex generation elements 1504 extend from an end of a first side portion of the baffle insert 1500 and the second set of vortex generation elements 1506 extend from an end of a second side portion of the baffle insert 1500. In this illustrative configuration, the vortex generation elements 1504, 1506 have generally rectangular geometries, which are arranged in an alternating pattern along the ends of the respective side portions. In this configuration, the pattern includes gaps 1508 in the radial direction (e.g., radial dimension gap). In some configurations, the gaps 1508 allow for a cooling flow to flow direction aftward (e.g., axial direction) without being directly impacted or interact with the vortex generation elements 1504, 1506. In this configuration, the gaps 1508 are radial gaps. In some embodiments, the gaps may be formed in the circumferential direction, with such gaps being a space or separation between the ends of the side portions of the baffle insert.

Figure 16:
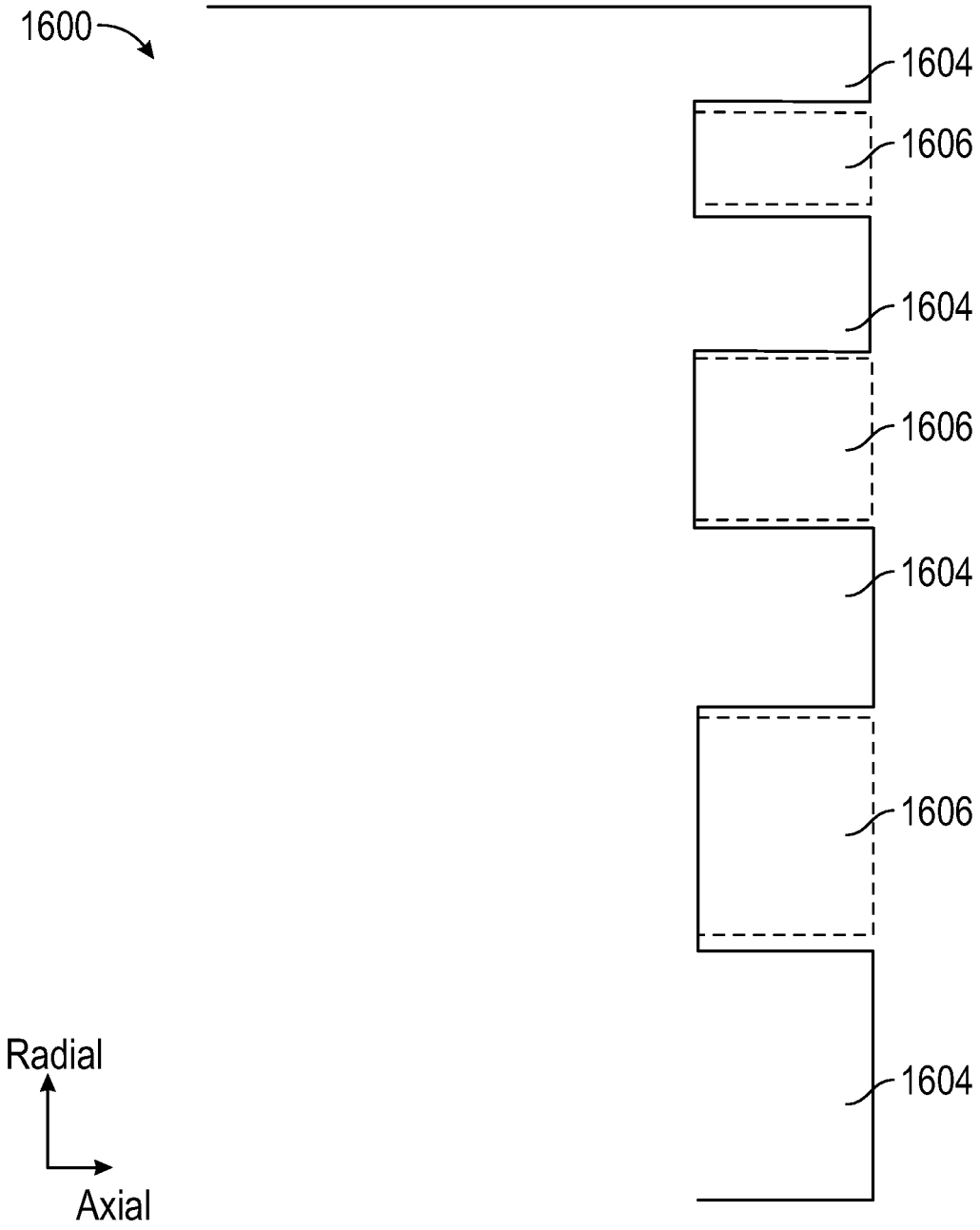
FIG. 16 is a schematic illustration of features of a baffle insert in accordance with an embodiment of the present disclosure.

Turning now to FIG. 16, a schematic illustration of a baffle insert 1600 a first set of vortex generation elements 1604 and a second set of vortex generation elements 1606 is shown. The first set of vortex generation elements 1604 extend from an end of a first side portion of the baffle insert 1600 and the second set of vortex generation elements 1606 extend from an end of a second side portion of the baffle insert 1600. In this illustrative configuration, the vortex generation elements 1604, 1606 have generally rectangular geometries, which are arranged in an alternating pattern along the ends of the respective side portions. In this configuration, the radial dimension of the individual vortex generation elements 1604, 1606 increases in a radially inward direction along the baffle insert 1600. This embodiment is illustrative in that each vortex generation element of the present disclosure may be geometrically different from other vortex generation elements of the same set of vortex generation elements.

It will be apparent to those of skill in the art that various combinations of types of vortex generation elements may be employed on a single baffle insert. For example, the different geometries and shapes illustrated in FIGS. 6-9 and the other varying characteristics and properties illustrated in FIGS. 11-16 may be mixed and matched to form a baffle insert having a desired vortex generation. In some embodiments, a combination of a first geometry (e.g., squared) may be used for a first set of vortex generation elements and a second geometry (e.g., triangular) may be used for a second set of vortex generation elements. Furthermore, within a single set vortex generation elements, different geometries and shapes may be used. For example, instead of or in combination with the different sized vortex generation elements shown in FIG. 16, each individual vortex generation element may have a similar or unique and different geometry/shape as compared to an adjacent vortex generation element. As such, it will be appreciated by those of skill in the art, in view of the teachings herein, that that any of the mentioned different characteristics/properties (e.g., height, length, shape, surface contour, angle, twist, radial gap, spacing, and radial pitch) may also be different between two sets of vortex generation elements and/or between any vortex generation elements within a given set. That is, any one vortex generation element can have a different height, length, shape, surface contour, angle, twist, radial gap, element spacing, and/or a variable radial spanwise pitch relative to any other adjacent vortex generation element of either the same set or the other set on a given baffle insert.

Although illustratively shown as having similar circumferential, radial and axial angles, the vortex generation elements of the present disclosure may also, or alternatively, have variable circumferential, radial, and axial angles, either within the same set and/or between sets of vortex generation elements on a given baffle. It should be noted that the circumferential and axial angles may also be referred to as chordwise, tangential, pressure-to-suction side, concave-to-convex, and/or spanwise angles. Those of skill in the art will understand, in view of the teachings provided herein, that each of the vortex generation elements may have unique geometric shapes, circumferential, radial, axial, and torsional angles, either within the same set or between sets (e.g., between two sets on a given baffle insert).

In some embodiments of the present disclosure, the vortex generation elements may be cut or formed into or from each end of a piece of sheet metal and then the sheet may be formed into shape. During this type of assembly and manufacture, by bringing the ends together, the vortex generation elements may interlock and securely connect or attach. In some embodiments, the end of the baffle insert may be welded shut or left partially open (e.g., creating gaps/apertures) to allow baffle air to be injected directly aft into the trailing edge cavity region. In another embodiment, the baffle insert may be made directly using additive manufacturing, so the vortex generation elements may be independent of the baffle walls (e.g., having a different thickness) and the baffle cavity could be sealed without additional processing steps. Further, in some embodiments, the tab-like structure of the vortex generation elements may be attached to a conventional or pre-formed baffle insert. In some such embodiments, the vortex generation elements may be welded to the baffle insert material. In other embodiments, fasteners, adhesives, bonding, or other types of attachment may be employed, without departing from the scope of the present disclosure.

In accordance with some non-limiting embodiments, when installed, it may be intended that the material of the vortex generation elements does not contact the hot walls or material of the airfoil body. Such non-contact may be beneficial to avoid, prevent, or minimize wear interactions between the baffle insert and the airfoil body. Further, such non-contact can prevent high temperatures being applied directly to the material of the baffle insert. However, advantageously, even if such contact occurs, airflow is still able to exit out the discharge holes at the aft end of the airfoil body due to the alternating construction of the interlocking vortex generation elements. Accordingly, even if contact between the baffle insert and the airfoil sidewalls occurs, and aft-flowing cooling flow will still be possible due to the arrangement of vortex generation elements in accordance with embodiments of the present disclosure.

Advantageously, embodiments described herein provide for improved cooling configurations for airfoil cavities containing a baffle. As described herein, the interlocking pattern of vortex generation elements causes vortices to form as a cooling air flow travels aft toward a trailing edge slot exit discharge of an airfoil body. The turbulent vortices can enhance local mixing along the internal surfaces of the aft cavity exterior walls, thus enhancing the convective heat transfer. The vortices allow heat transfer to be increased in a region that would otherwise be spatially limiting for physical cooling features. The baffle inserts described herein may be employed in any type of airfoil body construction (e.g., nickel, ceramic matric composite, etc.).

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions, combinations, sub-combinations, or equivalent arrangements not heretofore described, but which are commensurate with the spirit and scope of the present disclosure. Additionally, while various embodiments of the present disclosure have been described, it is to be understood that aspects of the present disclosure may include only some of the described embodiments.

Accordingly, the present disclosure is not to be seen as limited by the foregoing description, but is only limited by the scope of the appended claims.

What is claimed is:

1. A baffle insert for an airfoil of a gas turbine engine, the baffle insert comprising:

a baffle insert body having a first side portion and a second side portion, wherein each side portion has a respective end;

a first set of vortex generation elements arranged at the end of the first side portion; and a second set of vortex generation elements arranged at the end of the second side portion, wherein the first set of vortex generation elements and the second set of vortex generation elements are arranged at an aft end of the baffle insert body, wherein the end of the first side portion is joined with the end of the second side portion and the first set of vortex generation elements and the second set of vortex generation elements are arranged in an alternating and overlapping pattern where the first side portion joins with the second side portion.

2. The baffle insert of claim 1, wherein a gap is defined at the aft end of the baffle insert body to allow air to flow aftward through the gap.

3. The baffle insert of claim 1, wherein the baffle insert body is formed from sheet metal.

4. The baffle insert of claim 1, wherein each vortex generation element of at least one of the first set of vortex generation elements and the second set of vortex generation elements has a squared-shape geometry.

5. The baffle insert of claim 1, wherein each vortex generation element of at least one of the first set of vortex generation elements and the second set of vortex generation elements has a triangular-shaped geometry.

6. The baffle insert of claim 1, wherein each vortex generation element of at least one of the first set of vortex generation elements and the second set of vortex generation elements has a round-shaped geometry.

7. The baffle insert of claim 1, wherein at least one vortex generation element of at least one of the first set of vortex generation elements and the second set of vortex generation elements has a geometry that is different than at least one other vortex generation element of the respective set of vortex generation elements.

8. The baffle insert of claim 1, wherein each vortex generation element of the first set of vortex generation elements is welded to the end of the first side portion.

9. The baffle insert of claim 1, wherein each vortex generation element of at least one of the first set of vortex generation elements and the second set of vortex generation elements includes a twist.

10. The baffle insert of claim 1, wherein each vortex generation element of at least one of the first set of vortex generation elements and the second set of vortex generation elements is angled relative to a respective side portion of the baffle insert body.

11. The baffle insert of claim 1, wherein the vortex generation elements of the first and second sets are defined by a material thickness different than a material thickness of the baffle insert body.

12. The baffle insert of claim 1, wherein a radial dimension gap is formed between each vortex generation element of the first set of vortex generation elements and each vortex generation element of the second set of vortex generation elements.

13. The baffle insert of claim 1, wherein the first set of vortex generation elements has a first vortex generation element having a first radial length and a first axial length and a second vortex generation element having a second radial length and a second axial length.

14. The baffle insert of claim 13, wherein the first radial length and the second radial length are the same and the first axial length and the second axial length are the same.

15. The baffle insert of claim 13, wherein at least one of (i) the first radial length is different from the second radial length and (ii) the first axial length is different from the second axial length.

16. The baffle insert of claim 1, wherein the baffle insert body includes a plurality of impingement apertures at a location forward of the aft end of the baffle insert body.

17. The baffle insert of claim 1, wherein the baffle insert body includes a leading edge portion that defines a leading edge of the baffle insert body.

18. A component for a gas turbine engine comprising:

an airfoil body having a pressure side hot wall and a suction side hot wall that join at a trailing edge of the airfoil body, wherein the airfoil body defines an interior cavity; and a baffle insert arranged within the interior cavity of the airfoil body, the baffle insert having a baffle insert body having a first side portion and a second side portion, wherein each side portion has a respective end, a first set of vortex generation elements arranged at the end of the first side portion, and a second set of vortex generation elements arranged at the end of the second side portion, wherein the first set of vortex generation elements and the second set of vortex generation elements are arranged at an aft end of the baffle insert body, wherein the end of the first side portion is joined with the end of the second side portion and the first set of vortex generation elements and the second set of vortex generation elements are arranged in an alternating and overlapping pattern where the first side portion joins with the second side portion.

19. The component of claim 18, wherein the baffle insert body includes a plurality of impingement apertures at a location forward of the aft end of the baffle insert body and configured to direct an impinging flow from a baffle cavity onto the pressure side hot wall and the suction side hot wall.

20. The component of claim 18, wherein the airfoil body further includes a trailing edge cavity, wherein the first set of vortex generation elements and the second set of vortex generation elements are arranged forward of the trailing edge cavity and configured to generate a scrubbing flow of cooling air along the pressure side hot wall and the suction side hot wall.

* * * * *